US008635981B2

(12) United States Patent
Boegershausen

(10) Patent No.: US 8,635,981 B2
(45) Date of Patent: Jan. 28, 2014

(54) MECHANICAL VALVE CLEARANCE COMPENSATION ELEMENT WITH TWO-PART ADJUSTING BOLTS

(75) Inventor: Mathias Boegershausen, Puschendorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 161 days.

(21) Appl. No.: 13/180,700

(22) Filed: Jul. 12, 2011

(65) Prior Publication Data

US 2012/0006293 A1 Jan. 12, 2012

(30) Foreign Application Priority Data

Jul. 12, 2010 (DE) ..... 10 2010 026 860

(51) Int. Cl.
*F01L 1/14* (2006.01)

(52) U.S. Cl.
USPC ..... 123/90.59; 123/90.52

(58) Field of Classification Search
USPC ..... 123/90.45, 90.46, 90.52–90.59
See application file for complete search history.

(56) References Cited

U.S. PATENT DOCUMENTS

| | | | | |
|---|---|---|---|---|
| 2,308,858 | A * | 1/1943 | Burkhardt | 123/90.49 |
| 4,981,117 | A * | 1/1991 | McRobert et al. | 123/90.43 |
| 2003/0075131 | A1* | 4/2003 | Gill | 123/90.45 |

FOREIGN PATENT DOCUMENTS

| | | |
|---|---|---|
| DE | 3883547 | 10/1990 |
| WO | 2009096353 | 8/2009 |

* cited by examiner

*Primary Examiner* — Zelalem Eshete
(74) *Attorney, Agent, or Firm* — Volpe and Koenig, P.C.

(57) ABSTRACT

Valve clearance compensation element (1) with mechanical, automatic readjustment for internal combustion engines, with an adjusting bolt (3) that is supported in a sleeve (2) arranged on a component of the internal combustion engine by a thread against the force of a spring (8), with a transfer element that is in active connection with a support head (4) of the adjusting bolt (3) and is further supported on a spring-loaded gas-exchange valve and on a cam of a camshaft driven by the internal combustion engine. The adjusting bolt (3) has two parts, the support head (4) and a threaded bolt (5), which are fastened to each other.

6 Claims, 1 Drawing Sheet

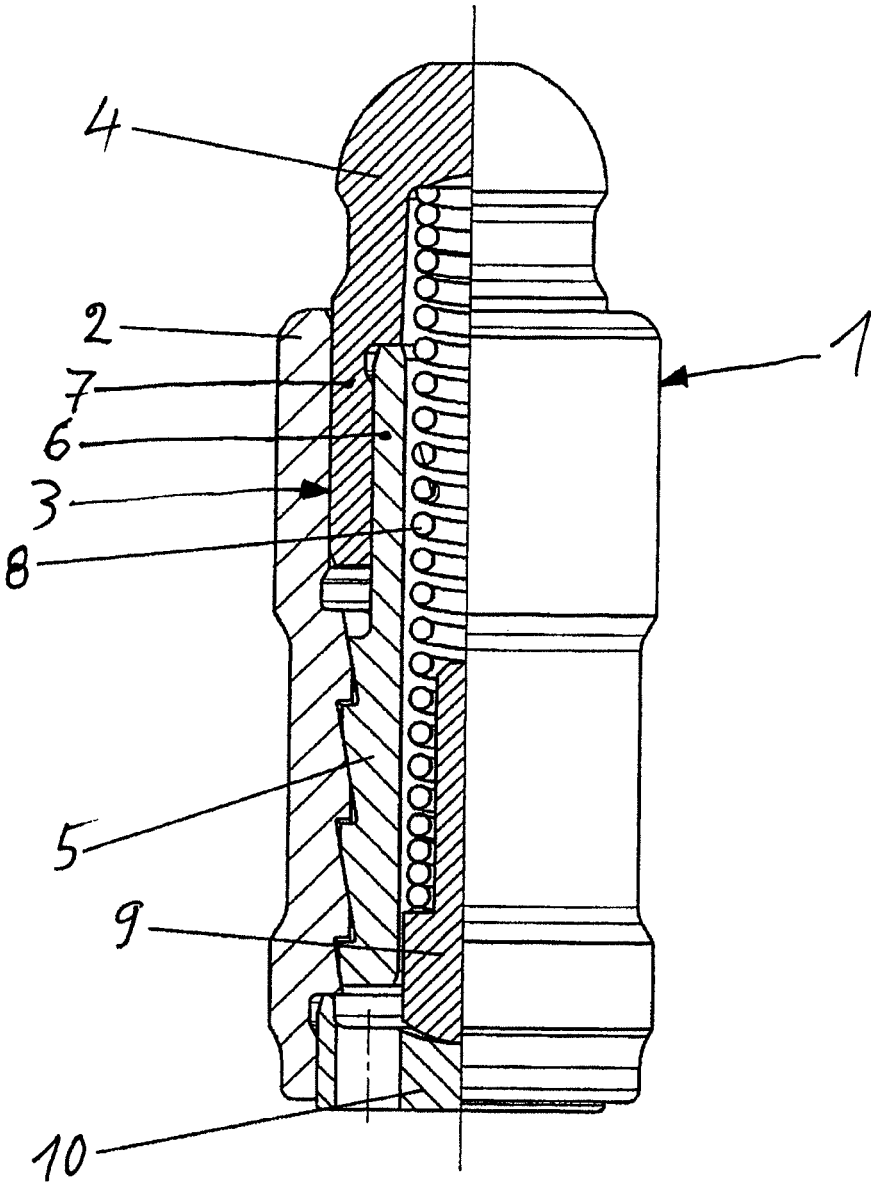
4
2
7
6
3
8
5
9
10
1

MECHANICAL VALVE CLEARANCE COMPENSATION ELEMENT WITH TWO-PART ADJUSTING BOLTS

CROSS-REFERENCE TO RELATED APPLICATIONS

This application claims the benefit of German Patent Application No. 102010026860.7, filed Jul. 12, 2010, which is incorporated herein by reference as if fully set forth.

FIELD OF THE INVENTION

A valve clearance compensation element with mechanical, automatic readjustment for internal combustion engines is provided, with an adjusting bolt that is supported in a sleeve arranged on a component of the internal combustion engine via a thread against the force of a spring, with a transfer element that is in active connection with a support head of the adjusting bolt and is further supported on a spring-loaded gas-exchange valve and on a cam of a camshaft driven by the internal combustion engine.

BACKGROUND

In order to achieve good efficiency values for the elongation of the mechanical valve clearance compensation element, it is necessary to use a thread with a large pitch, advantageously an angle greater than 12°. A good efficiency value in the case of elongation makes possible low spring forces and therefore low contact forces in the root circle of the cam, which leads to low friction losses in the valve drive.

If a thread with a corresponding pitch is cut on an adjusting bolt, the guide length in the sleeve is lost partially or even completely, because in the case of thread cutting, a thread run-out must always be taken into consideration that corresponds to at least 1×the pitch.

Such a valve clearance compensation element is known from WO 2009/096353 A1. In order to compensate the thread run-out, the sleeve and the adjusting bolt are built relatively long, wherein also the distance of the support head from the thread is long and the support head is limited in diameter. Because the adjusting bolt has a continuous thread and the thread always has a radial play, the guide of the transfer element on the support head is not provided with sufficient reliability, so that there are variations and inaccuracies in the valve drive.

Furthermore, a valve clearance compensation element is known, DE-38 83 547 T2, in which grooves are machined into the thread of the adjusting bolt, in order to increase the self-locking. This, however, produces the disadvantage that there is the risk of increased wear and increased clearance, which likewise leads to variations and inaccuracies in the valve drive, because the thread is the sole guidance of the adjusting bolt in the sleeve.

SUMMARY

The objective of the invention is therefore to improve a valve clearance compensation element to the extent that the described disadvantages are avoided and a sufficient and good guidance of the adjusting bolt in the sleeve is to be provided. This is to be realized economically with simple means and is to be operationally reliable.

This objective is met in that the adjusting bolt has two parts, the support head and a threaded bolt, which are fastened to each other. The fastening can be realized by any means familiar to someone skilled in the art. Advantageously, the threaded bolt has a neck with a circular cylindrical face on which the support head is pressed. Such a fastening is simple in production and thus economical. The support head has, on its side, a casing with circular cylindrical inner and outer faces, wherein, with its inner face, the casing is in active connection with the threaded bolt and is supported with its outer face in a sliding manner in the sleeve, advantageously in a guide surface of the sleeve. Through this configuration, a long, good guidance of the adjusting bolt or the support head in the sleeve is provided, so that variations and inaccuracies in the valve drive cannot occur.

Because the neck of the threaded bolt and also the guide surface in the sleeve are offset in the radial direction, no additional thread run-out is required, because the neck is used as the thread run-out. The thread can be constructed here as a single-start or also multiple-start thread, wherein a multiple-start thread is finer. Consequently, in the processing, less material must be taken away, which reduces the production costs.

Through this two-part configuration of the adjusting bolt, a significantly higher shape freedom is achieved with respect to the thread and the guidance.

Because the two parts of the adjusting bolt can be easily produced individually, these are advantageously finished and are pressed one onto the other only at the end.

Through the two-part configuration of the adjusting bolt, the production of the recess for the spring, in particular, in the threaded bolt, is made simpler, because it involves a continuous recess, wherein according to the configuration of the spring, a recess or drilled hole could also be formed in the support head. The spring is here guided and supported in the threaded bolt and/or in the support head with its other end on a spring guide that is guided with a clearance fit in the threaded bolt and/or in a base that is fastened to the sleeve. The spring guide has a spherical surface that is guided in a cup of the base.

BRIEF DESCRIPTION OF THE DRAWING

For further explanation of the invention, reference is made to the drawing in which embodiments of the invention are illustrated in simplified form.

Shown are:

FIG. 1 is a partial section view through a valve clearance compensation element with two-part configuration of the adjusting bolt.

DETAILED DESCRIPTION OF THE PREFERRED EMBODIMENTS

In FIG. 1, a valve clearance compensation element is designated, in general, with 1, which has a sleeve 2 and an adjusting bolt 3 arranged in the sleeve. The adjusting bolt 3 has a two-part construction and has a support head 4 and a threaded bolt 5 that corresponds to a thread in the sleeve 2. The threaded bolt 5 has a neck 6 that is pressed into a casing 7 of the support head 4. The casing 7 of the support head 4 has, in addition to its inner face on the casing, an outer face by which it is supported in a sliding manner in a guide surface of the sleeve 2. Through this configuration of the adjusting bolt 3, on one hand, a very good guidance of the adjusting bolt 3 or the support thread 4 in the sleeve 2 is guaranteed and, in addition, a run-out for the thread in the sleeve 2 is provided.

Through the radial reduction in diameter of the neck 6 on the threaded bolt 5, a good thread run-out is also present on the threaded bolt 5. In this way, the subsequent thread could have a single-start or also multiple-start construction. In a drilled hole of the threaded bolt 5 and the support head 4, a spring 8 is guided in the radial direction, which surrounds the bolt of a spring guide 9 and is supported on this guide 9. The spring guide 9 is guided on its side in the drilled hole of the threaded bolt 5 by a clearance fit and is supported on a base 10 that is pressed into the sleeve 2. The base has a cup that faces the spring guide 9 and corresponds to a spherical surface of the spring guide 9, so that the spring 8 can rotate slightly in the sleeve 2 for the adjustment and thus rotation of the adjusting bolt 3.

LIST OF REFERENCE SYMBOLS

1 Valve clearance compensation element
2 Sleeve
3 Adjusting bolt
4 Support head
5 Threaded bolt
6 Neck
7 Casing
8 Spring
9 Spring guide
10 Base

The invention claimed is:

1. A valve clearance compensation element with mechanical, automatic readjustment for internal combustion engines, comprising an adjusting bolt that is supported by a thread in a sleeve arranged on a component of the internal combustion engine against a force of a spring with a transfer element that is in active connection with a support head of the adjusting bolt, a spring-loaded gas-exchange valve and a cam of a camshaft driven by the internal combustion engine, and the adjusting bolt has two parts, the support head and a threaded bolt, which are fastened to each other, the threaded bolt has a neck with a circular cylindrical face on which the support head is pressed, and the support head has a casing with a circular cylindrical inner and outer face and that, with said inner face, the casing is in active connection with the threaded bolt.

2. The valve clearance compensation element according to claim 1, wherein the support head is supported with an outer surface thereof in a sliding manner in the sleeve.

3. The valve clearance compensation element according to claim 1, wherein at least one of the threaded bolt or the support head have a recess in which the spring is guided in the radial direction.

4. The valve clearance compensation element according to claim 3, wherein the spring is arranged on its end facing away from the support head on a spring guide that is guided with a clearance fit in the recess of the threaded bolt.

5. The valve clearance compensation element according to claim 1, wherein the threads on the sleeve and on the threaded bolt are machined following a neck of the threaded bolt and the casing.

6. The valve clearance compensation element according to claim 5, wherein at least one of the neck of the threaded bolt or a guide surface in the sleeve are offset in a radial direction and are used as thread run-outs.

* * * * *